US011098573B2

(12) United States Patent
Vakil et al.

(10) Patent No.: US 11,098,573 B2
(45) Date of Patent: Aug. 24, 2021

(54) SYSTEMS AND METHODS FOR ESTIMATING DRILL BIT ROTATIONAL VELOCITY USING TOP DRIVE TORQUE AND ROTATIONAL VELOCITY

(71) Applicant: NABORS DRILLING TECHNOLOGIES USA, INC., Houston, TX (US)

(72) Inventors: Mohammad Vakil, Calgary (CA); Douglas Christian Greening, Calgary (CA)

(73) Assignee: Nabors Drilling Technologies USA, Inc., Houston, TX (US)

( * ) Notice: Subject to any disclaimer, the term of this patent is extended or adjusted under 35 U.S.C. 154(b) by 773 days.

(21) Appl. No.: 15/920,238

(22) Filed: Mar. 13, 2018

(65) Prior Publication Data

US 2019/0284923 A1 Sep. 19, 2019

(51) Int. Cl.

| | |
|---|---|
| ***E21B 44/04*** | (2006.01) |
| ***E21B 47/00*** | (2012.01) |
| ***E21B 3/02*** | (2006.01) |
| ***E21B 21/08*** | (2006.01) |
| ***E21B 44/06*** | (2006.01) |

(52) U.S. Cl.

CPC ..... *E21B 44/04* (2013.01); *E21B 3/02* (2013.01); *E21B 21/08* (2013.01); *E21B 44/06* (2013.01); *E21B 47/00* (2013.01); *E21B 2200/20* (2020.05)

(58) Field of Classification Search

CPC . E21B 44/04; E21B 3/02; E21B 21/08; E21B 44/06; E21B 47/00; E21B 2200/20

USPC ..... 703/2

See application file for complete search history.

(56) References Cited

U.S. PATENT DOCUMENTS

| | | | | |
|---|---|---|---|---|
| 9,482,083 | B2 * | 11/2016 | Doris | E21B 44/00 |
| 2005/0149306 | A1 * | 7/2005 | King | E21B 49/003 703/10 |
| 2011/0245980 | A1 * | 10/2011 | Nessjoen | E21B 44/00 700/280 |
| 2011/0280104 | A1 * | 11/2011 | McClung, III | E21B 3/02 367/82 |
| 2012/0123757 | A1 | 5/2012 | Ertas et al. | |
| 2015/0322766 | A1 * | 11/2015 | Veltman | E21B 44/00 340/853.6 |
| 2017/0152736 | A1 | 6/2017 | Kyllingstad | |

* cited by examiner

*Primary Examiner* — Justin C Mikowski

(74) *Attorney, Agent, or Firm* — Abel Schillinger, LLP; Enrique Abarca

(57) ABSTRACT

The present disclosure is directed to systems and methods for estimating rotational velocity and/or torque of a drill bit during certain drilling operations using torque and rotational velocity measured at a top drive system of the drilling operations. In certain embodiments, a drilling control system may estimate the rotational velocity and/or the torque of the drill bit using torque and rotational velocity detected at the top drive system, in conjunction with the governing equations of the drill string, the top drive, and the bottom hole assembly (including the drill bit itself), which may be transferred into the Laplace domain. In other embodiments, the drilling control system may estimate the rotational velocity and/or the torque of the drill bit using the torque and rotational velocity detected at the top drive system, in conjunction with a finite dimensional model approximation of the drill string based on an assumed mode shape of the drill string or a finite element model of the drill string.

8 Claims, 6 Drawing Sheets

SYSTEMS AND METHODS FOR ESTIMATING DRILL BIT ROTATIONAL VELOCITY USING TOP DRIVE TORQUE AND ROTATIONAL VELOCITY

BACKGROUND

Embodiments of the present disclosure relate generally to the field of drilling and processing of wells. More particularly, present embodiments relate to systems and methods for estimating rotational velocity and/or torque of a drill bit during certain drilling operations using torque and rotational velocity, as well as mud pump flow, as measured at a top drive system of the drilling operations.

In conventional oil and gas operations, a well is typically drilled to a desired depth with a drill string, which may include drill pipe and a drill bit. The drill pipe may include multiple sections of tubular that are coupled to one another by threaded connections or tool joints. During a drilling process, the drill string may be supported and hoisted about a drilling rig and be lowered into a well. A drive system (e.g., a top drive) at the surface may rotate the drill string to facilitate drilling a borehole. In general, the actual rotational velocity and actual torque of the drill bit may not be directly measurable. As such, systems and methods for estimating the rotational velocity and/or the torque of the drill bit are desirable.

BRIEF DESCRIPTION

In accordance with one aspect of the disclosure, a method includes receiving sensor data relating to operating parameters of a top drive system of a drilling rig from sensors of the top drive system. The method also includes estimating, using at least one processor, at least one operating parameter of a drill bit using a dimensional model of operating components of the drilling rig, and using the sensor data received from the sensors of the top drive system. The method further includes controlling, using the at least one processor, operation of the top drive system based at least in part on the estimated at least one operating parameter of the drill bit.

In accordance with another aspect of the disclosure, a method includes receiving sensor data relating to operating parameters of a top drive system of a drilling rig from sensors of the top drive system. The method also includes estimating, using at least one processor, at least one operating parameter of a drill bit using an infinite dimensional model wherein governing equations of operating components of the drilling rig are transferred into the Laplace domain, and using the sensor data received from the sensors of the top drive system.

In accordance with another aspect of the disclosure, a method includes receiving sensor data relating to operating parameters of a top drive system of a drilling rig from sensors of the top drive system. The method also includes estimating, using at least one processor, at least one operating parameter of a drill bit using a finite dimensional model based on an assumed mode shape of operating components of the drilling rig, and using the sensor data received from the sensors of the top drive system.

In accordance with another aspect of the disclosure, a method includes receiving sensor data relating to operating parameters of a top drive system of a drilling rig from sensors of the top drive system. The method also includes estimating, using at least one processor, at least one operating parameter of a drill bit using a finite dimensional model based on a finite element model of operating components of the drilling rig, and using the sensor data received from the sensors of the top drive system.

DRAWINGS

These and other features, aspects, and advantages of the present disclosure will become better understood when the following detailed description is read with reference to the accompanying drawings in which like characters represent like parts throughout the drawings, wherein.

Figure 6:
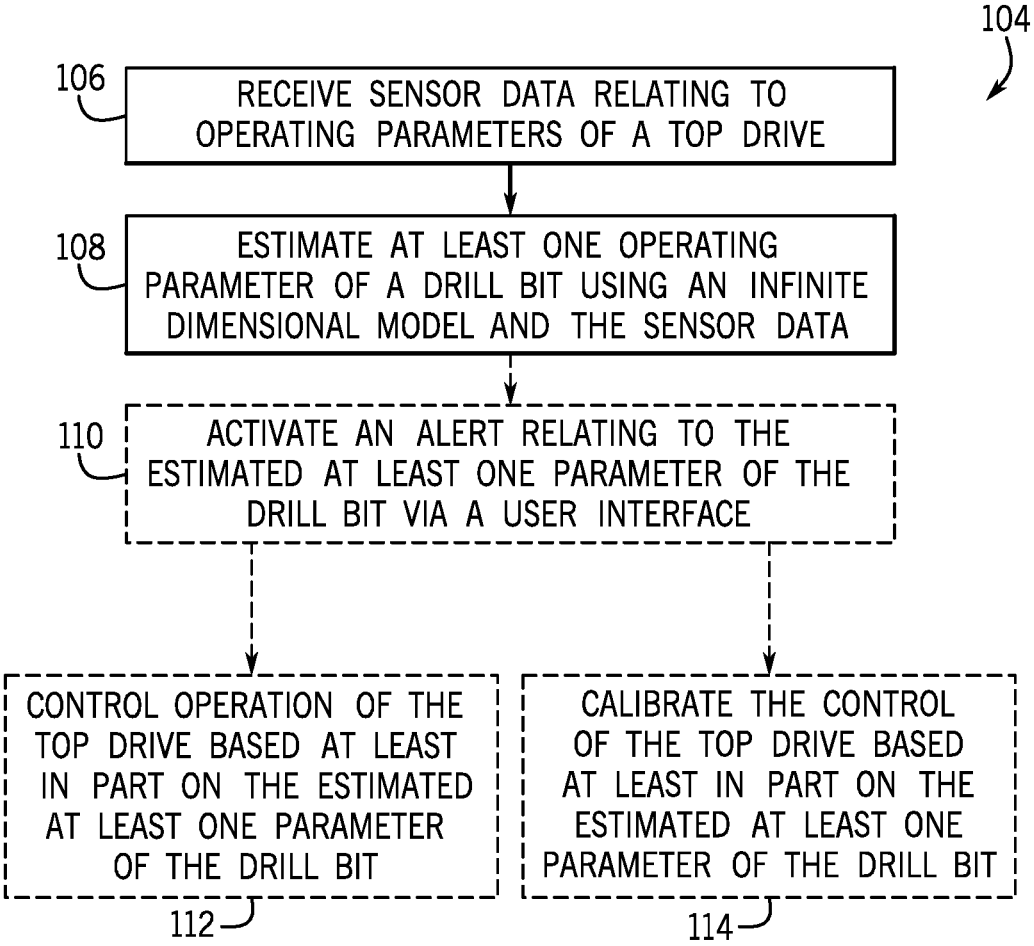
Figure 7:
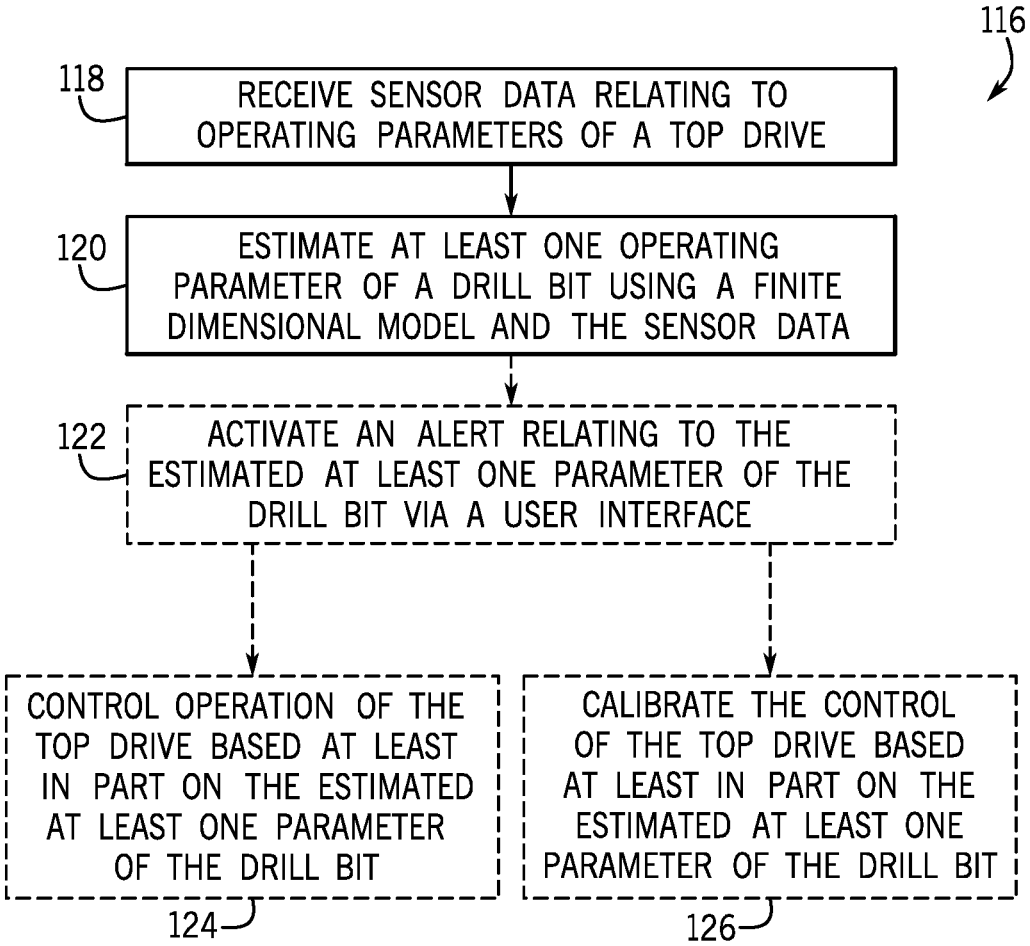

FIG. 6 is a flow chart of a method for estimating rotational velocity and/or torque of a drill bit using the infinite dimensional model approximation techniques in accordance with present techniques; and FIG. 7 is a flow chart of a method for estimating rotational velocity and/or torque of the drill bit using the finite dimensional model approximation techniques in accordance with present techniques.

DETAILED DESCRIPTION

Provided herein are techniques for estimating rotational velocity and/or torque of a drill bit during certain drilling operations using torque and rotational velocity measured at a top drive system of the drilling operations. In certain embodiments, one or more sensors may be coupled to the top drive system to detect the surface torque and rotational velocity in real time. In certain embodiments, a drilling control system may estimate the rotational velocity and/or the torque of the drill bit using the torque and rotational velocity detected at the top drive system, in conjunction with the governing equations of the drill string, the top drive, and the bottom hole assembly (including the drill bit itself), which may be transferred into the Laplace domain. In other embodiments, the drilling control system may estimate the rotational velocity and/or the torque of the drill bit using the torque and rotational velocity detected at the top drive system, in conjunction with a finite dimensional model approximation of the drill string based on an assumed mode shape of the drill string or a finite element model of the drill string.

In certain embodiments, the drilling control system may use the estimated rotational velocity and/or torque of the drill bit as a closed-loop control variable to adjust certain operating parameters of the drilling rig, particularly the torque and rotational velocity of the top drive system. For example, in general, the drilling control system will attempt to maintain the rotational velocity and/or the torque of the drill bit between upper and lower operating limits to ensure that the operating life of the drill bit is maximized. While downhole data may be utilized in accordance with present embodiments, it should be noted that a controller in accordance with certain embodiments of the present disclosure does not use downhole data. Indeed, in certain onshore and offshore rigs, such downhole data is unavailable. Accordingly, a benefit of present embodiments includes operation based on surface signals alone to estimate downhole behavior.

Figure 1:
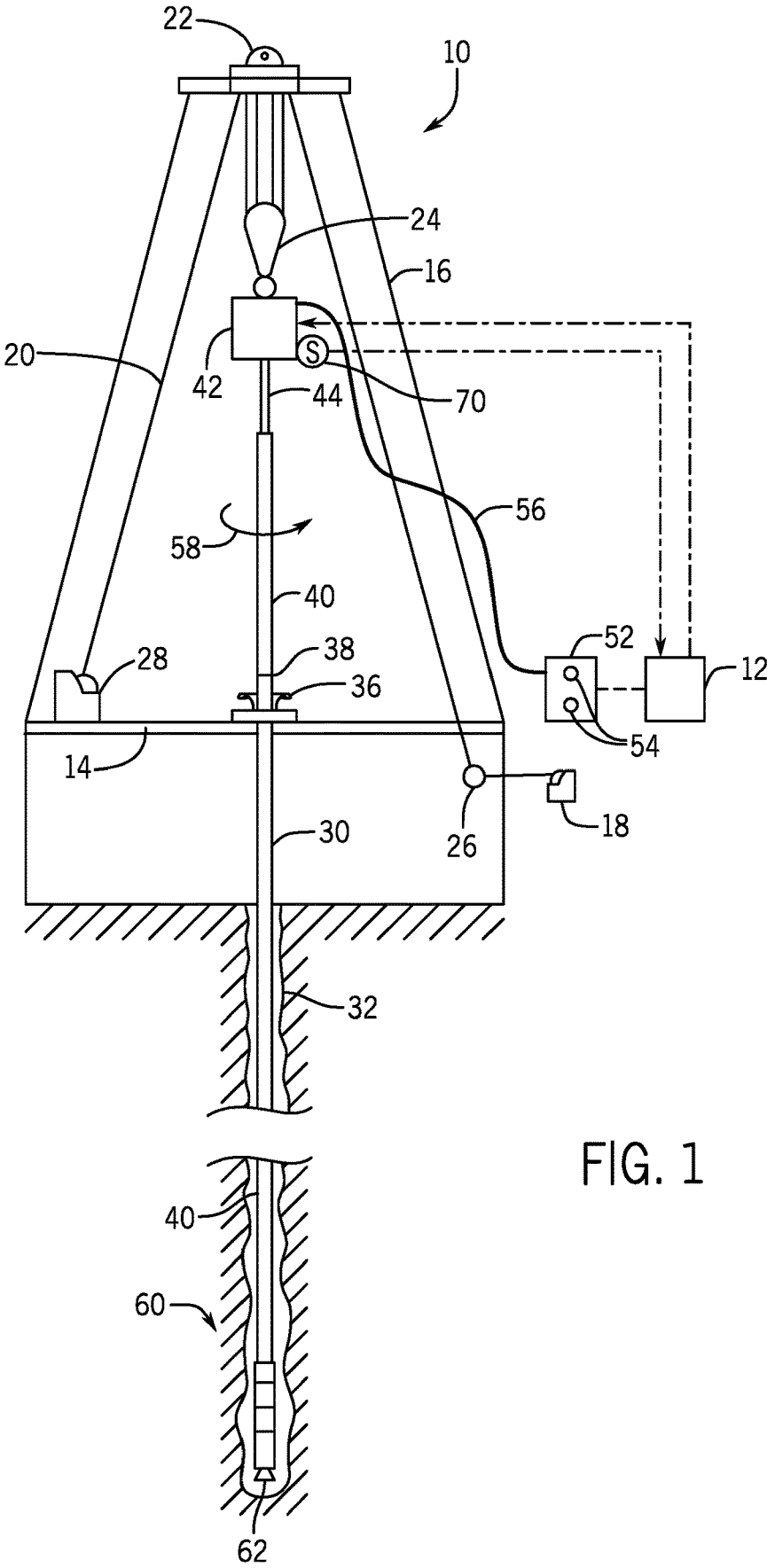
FIG. 1 is a schematic of a drilling rig including a drilling control system in accordance with present techniques.

With the foregoing in mind, FIG. 1 illustrates a schematic of a drilling rig 10 including a drilling control system 12 in accordance with the present disclosure. The drilling rig 10 features an elevated rig floor 14 and a derrick 16 extending above the rig floor 14. A supply reel 18 supplies drilling line 20 to a crown block 22 and traveling block 24 configured to hoist various types of drilling equipment above the rig floor 14. The drilling line 20 is secured to a deadline tiedown anchor 26, and a drawworks 28 regulates the amount of drilling line 20 in use and, consequently, the height of the traveling block 24 at a given moment. Below the rig floor 14, a drill string 30 extends downward into a wellbore 32 and is held stationary with respect to the rig floor 14 by slips 36. The drill string 30 may include multiple sections of threaded tubular 40 that are threadably coupled together. It should be noted that present embodiments may be utilized with drill pipe, casing, or other types of tubular.

A portion of the drill string 30 extends above the rig floor 14 and is coupled to a top drive 42. The top drive 42, hoisted by the traveling block 24, may engage and position the drill string 30 (e.g., a section of the tubular 40) above the wellbore 32. Specifically, the top drive 42 includes a quill 44 used to turn the tubular 40 and, consequently, the drill string 30 for drilling operations. After setting or landing the drill string 30 in place such that the male threads of one section (e.g., one or more joints) of the tubular 40 and the female threads of another section of the tubular 40 are engaged, the two sections of the tubular 40 may be joined by rotating one section relative to the other section (e.g., in a clockwise direction) such that the threaded portions tighten together. Thus, the two sections of tubular 40 may be threadably joined. During other phases of operation of the drilling rig 10, the top drive 42 may be utilized to disconnect and remove sections of the tubular 40 from the drill string 30. As the drill string 30 is removed from the wellbore 32, the sections of the tubular 40 may be detached by disengaging the corresponding male and female threads of the respective sections of the tubular 40 via rotation of one section relative to the other in a direction opposite that used for coupling.

The drilling rig 10 functions to drill the wellbore 32. Indeed, the drilling rig 10 includes the drilling control system 12 in accordance with the present disclosure. The drilling control system 12 may coordinate with certain aspects of the drilling rig 10 to perform certain drilling techniques. For example, the drilling control system 12 may control and coordinate rotation of the drill string 30 via the top drive 42 and supply of drilling mud to the wellbore 32 via a pumping system 52. The pumping system 52 includes a pump or pumps 54 and conduit or tubing 56. The pumps 54 are configured to pump drilling fluid downhole via the tubing 56, which communicatively couples the pumps 52 to the wellbore 32. In the illustrated embodiment, the pumps 54 and tubing 56 are configured to deliver drilling mud to the wellbore 32 via the top drive 42. Specifically, the pumps 54 deliver the drilling mud to the top drive 42 via the tubing 56, the top drive 42 delivers the drilling mud into the drill string 30 via a passage through the quill 44, and the drill string 30 delivers the drilling mud to the wellbore 32 when properly engaged in the wellbore 32. The drilling control system 12 manipulates aspects of this process to facilitate performance of specific drilling strategies in accordance with present embodiments. For example, the drilling control system 12 may control rotation of the drill string 30 and supply of the drilling mud by controlling operational characteristics of the top drive 42 and pumping system 52 based on inputs received from sensors and manual inputs.

In the illustrated embodiment, the top drive 42 is being utilized to transfer rotary motion to the drill string 30 via the quill 44, as indicated by arrow 58. In other embodiments, different drive systems (e.g., a rotary table, coiled tubing system, downhole motor) may be utilized to rotate the drill string 30 (or vibrate the drill string 30). Where appropriate, such drive systems may be used in place of the top drive 42. It should be noted that the illustration of FIG. 1 is intentionally simplified to focus on particular features of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, the well, in practice, may include one or more deviations, including angled and horizontal runs. Similarly, while shown as a surface (land-based) operation, the well may be formed in water of various depths, in which case the topside equipment may include an anchored or floating platform.

In the illustrated embodiment, the drill string 30 includes a bottom-hole assembly (BHA) 60 coupled to the bottom of the drill string 30. The BHA 60 includes a drill bit 62 that is configured for drilling the downhole end of the wellbore 32. Straight line drilling may be achieved by rotating the drill string 30 during drilling. In another embodiment, the drill bit 62 may include a bent axis motor-bit assembly or the like that is configured to guide the drill string 30 in a particular direction for directional drilling. The BHA 60 may include one or more downhole tools (e.g., a measurement-while-drilling (MWD) tool, a logging-while-drilling (LWD) tool) configured to provide data (e.g., via pressure pulse encoding through drilling fluid, acoustic encoding through drill pipe, electromagnetic transmissions) to the drilling control system 12 to facilitate drilling, including determining whether to rotate the drill string 26 via the top drive 42 and/or pump drilling mud via the pumping system 52. For example, the MWD tool and the LWD tool may obtain data including orientation of the drill bit 62, location of the BHA 60 within the wellbore 32, pressure and temperature within the wellbore 32, rotational information, mud pressure, tool face orientation, vibrations, torque, linear speed, rotational speed, and the like.

As will be discussed below, the top drive 42 and, consequently, the drill string 30 may be rotated based on instructions from the drilling control system 12, which may include automation and control features and algorithms for estimating rotational velocity and/or torque of the drill bit 62 based on measurement data and equipment. As illustrated, one or more sensors 70 may be coupled to the top drive 42 and configured to measure one or more parameters (e.g., torque, rotational speed, motor current) of the top drive 42 and to communicate the measured data to the drilling control system 12. Based on the measured data from the sensors 70 and/or the downhole tools (e.g., the MWD tool 64, the LWD tool 66), the drilling control system 12 may determine parameters of the drill string 30, such as the rotational velocity and/or the torque of the drill bit 62. The drilling control system 12 may control the rotation of the top drive 42 based on the data measured by the sensors 70, as well as other parameters (e.g., as measured by the downhole tools). In certain embodiments, to control the rotation of the top drive 42, the drilling control system 12 may also use other variables including pipe size, size of hole, tortuosity, type of bit, rotations per minute, mud flow, inclination, length of drill string, horizontal component of drill string, vertical component of drill string, mass of drill string, manual input, weight on the bit (WOB), azimuth, tool face positioning, downhole temperature, downhole pressure, or the like.

As described herein, in certain embodiments, the drilling control system 12 may include one or more automation controllers with one or more processors and memories that cooperate to store received data and implement programmed functionality based on the data and algorithms. In certain embodiments, the drilling control system 12 may communicate (e.g., via wireless communications, via dedicated wiring, or other communication systems) with various features of the drilling rig 10, including, but not limited to, the top drive 42, the pumping system 52, the drawworks 26, and downhole features (e.g., the BHA 60). In certain embodiments, a communication delay (e.g., between the sensors 70 and the drilling control system 12, and between the drilling control system 12 and the top drive 42) may be less than 50 milliseconds, such as less than 45 milliseconds, 40 milliseconds, 35 milliseconds, 30 milliseconds, 25 milliseconds, 20 milliseconds, 15 milliseconds, 10 milliseconds, or 5 milliseconds.

Figure 2:
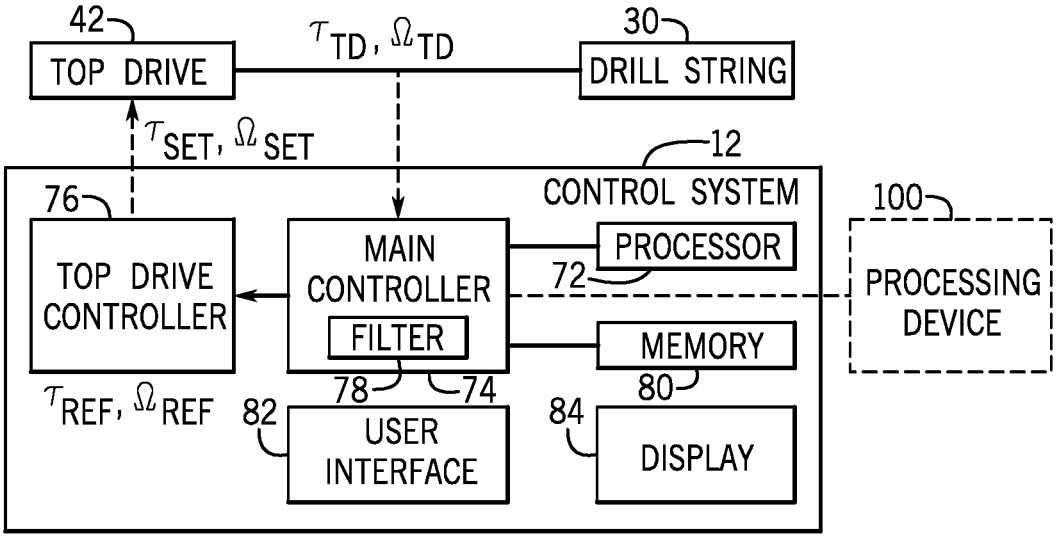
FIG. 2 is a schematic of a drilling control system of FIG. 1 in accordance with present techniques.

FIG. 2 illustrates schematically the drilling control system 12 in accordance with the present disclosure. As discussed above, the drilling control system 12 may control the rotation of the top drive 42 to rotate the drill string 30 for drilling the wellbore 32. In certain embodiments, the drilling control system 12 may include a distributed control system (DCS), a programmable logic controller (PLC), or any computer-based automation controller or set of automation controllers that is fully or partially automated. For example, the drilling control system 12 may be any device employing one or more general purpose or an application-specific processor(s) 72 for executing control algorithms as well as the algorithms described herein for estimating parameters of the drilling rig 10, specifically an estimated rotational velocity or torque of the drill bit 62. In the illustrated embodiment, the drilling control system 12 is separate from the top drive 42. It should be noted that, in some embodiments, aspects of the drilling control system 12 may be integrated with the top drive 42 or other features (e.g., the BHA 60).

The drilling control system 12 includes a main controller 74 and a top drive controller 76 for controlling the rotation of the top drive 42. In certain embodiments, the main controller 74 uses measurements of torque $\tau_{TD}$ and rotational velocity $\dot{\alpha}_{TD}$ of the top drive 42, as measured by the one or more sensors 70, among other parameters of the drilling rig 10 measured by the one or more sensors 70 and/or the downhole tools (e.g., the MWD tool 64, the LWD tool 66), as input variables. In certain embodiments, the main controller 74 may include a filter 78 (e.g., a band-pass filter) configured to filter out zero frequency components (e.g., DC components) and high frequency components of the measured torque $\tau_{TD}$ and rotational velocity $\dot{\alpha}_{TD}$ of the top drive 42.

In certain embodiments, the top drive controller 76 includes a PI controller (or a proportional-integral-derivative (PID) controller) that includes a reference torque $\tau_{ref}$ and a reference rotational velocity $\dot{\alpha}_{ref}$ for the top drive 42, both of which may be adjusted by the main controller 74 in response to the measured torque $\tau_{TD}$ and rotational velocity $\dot{\alpha}_{TD}$ of the top drive 42, and used to set a torque $\tau_{set}$ and rotational velocity $\dot{\alpha}_{set}$ of the top drive 42. In particular, as described in greater detail herein, the main controller 74 may use the measured torque $\tau_{TD}$ and rotational velocity $\dot{\alpha}_{TD}$ of the top drive 42 to estimate a rotational velocity and/or torque of the drill bit 62, and the estimated rotational velocity and/or torque of the drill bit 62 may be used by the main controller 74 as a closed-loop control variable to adjust the reference torque $\tau_{ref}$ and the reference rotational velocity $\dot{\alpha}_{ref}$ for the top drive 42. For example, in general, the drilling control system 12 will attempt to maintain the rotational velocity and/or the torque of the drill bit 62 between upper and lower operating limits to ensure that the operating life of the drill bit 62 is maximized.

The drilling control system 12 may include one or more memory 80 for storing instructions executable by the main controller 74 and the top drive controller 76 (e.g., by processor(s) of the main controller 74 and the top drive controller 76) to perform methods and control actions described herein for the top drive 42. The memory 80 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the one or more processor(s) 72 or other machine with a processor.

The drilling control system 12 may also include other components, such as a user interface 82 and a display 84. Via the user interface 82, an operator may provide commands and operational parameters to the drilling control system 12 to control various aspects of the operation of the drilling rig 10. The user interface 82 may include a mouse, a keyboard, a touch screen, a writing pad, or any other suitable input and/or output devices. The commands may include start and stop of the top drive 42, detection and calculation of the estimated rotational velocity and/or torque of the drill bit 62 (e.g., provided by the main controller 74 and the top drive controller 76), and so forth. The operational parameters may include temperature and pressure of the BHA 60, the number of drill pipes in the drill string 30, the length, inner diameter, and outer diameter of each drill pipe, and so forth. The display 84 may be configured to display any suitable information of the drilling rig 10, such as the various operational parameters of the drilling rig 10, the torque $\tau_{TD}$ and rotational velocity $\dot{\alpha}_{TD}$ of the top drive 42 (e.g., as measured by the one or more sensors 70), the estimated rotational velocity and/or torque of the drill bit 62, and so forth.

As described herein, in certain embodiments, the main controller 74 may be used to estimate the rotational velocity and/or the torque of the drill bit 62 using the torque $\tau_{TD}$ and rotational velocity $\dot{\alpha}_{TD}$ of the top drive 42, as measured by the one or more sensors 70, in conjunction with the governing equations of the drill string 30, the top drive 42, and the BHA 60 (including the drill bit 62 itself), which may be transferred into the Laplace domain. This method may be referred to herein as an infinite dimensional model approximation. In other embodiments, the main controller 74 may be used to estimate the rotational velocity and/or the torque of the drill bit 62 using the torque $\tau_{TD}$ and rotational velocity $\dot{\alpha}_{TD}$ of the top drive 42, as measured by the one or more sensors 70, in conjunction with a finite dimensional model approximation of the drill string 30, the top drive 42, and the BHA 60 (including the drill bit 62 itself), based on an assumed mode shape of the drill string 30, for example.

While downhole data (e.g., as measured by the downhole tools (e.g., the MWD tool 64, the LWD tool 66) described herein may be utilized in accordance with present embodiments, it should be noted that a controller in accordance with certain embodiments of the present disclosure does not use downhole data. Indeed, in certain onshore and offshore rigs, such downhole data is unavailable. Accordingly, a benefit of present embodiments includes operation based on surface signals alone to estimate downhole behavior. However, in embodiments where downhole data is available, such downhole data may be provided to the main controller 74 of the drilling control system 12, and the main controller 74 may use the downhole data in various ways to supplement, but not entirely replace, the estimation of the rotational velocity and/or the torque of the drill bit 62 using the infinite and finite dimensional model approximation techniques described herein. For example, in certain embodiments, the downhole data may be used to calibrate the rotational velocity and/or the torque of the drill bit 62 estimated by the main controller 74. As but one non-limiting example, if the measured downhole data includes actual rotational velocity of the drill bit 62, the particular estimation model being used by the main controller 74 may be calibrated using, for example, a difference between the actual rotational velocity of the drill bit 62 and the estimated rotational velocity of the drill bit 62 as an input to the main controller 74. An advantage of using measured downhole data to merely calibrate the estimated rotational velocity and/or torque of the drill bit 62 using the actual rotational velocity and/or torque of the drill bit 62, as opposed to using the actual rotational velocity and/or torque of the drill bit 62 as closed-loop control feedback input, is that the sensors 70 near the top drive 42 may allow for much higher refresh rates (e.g., less than 50 milliseconds, less than 45 milliseconds, 40 milliseconds, 35 milliseconds, 30 milliseconds, 25 milliseconds, 20 milliseconds, 15 milliseconds, 10 milliseconds, or 5 milliseconds) than relying on receiving measurement data from the downhole tools (e.g., the MWD tool 64, the LWD tool 66), which can have communication delays on the order of more than 1 second, more than 2 seconds, more than 3 seconds, more than 5 seconds, or even longer.

Figure 3:
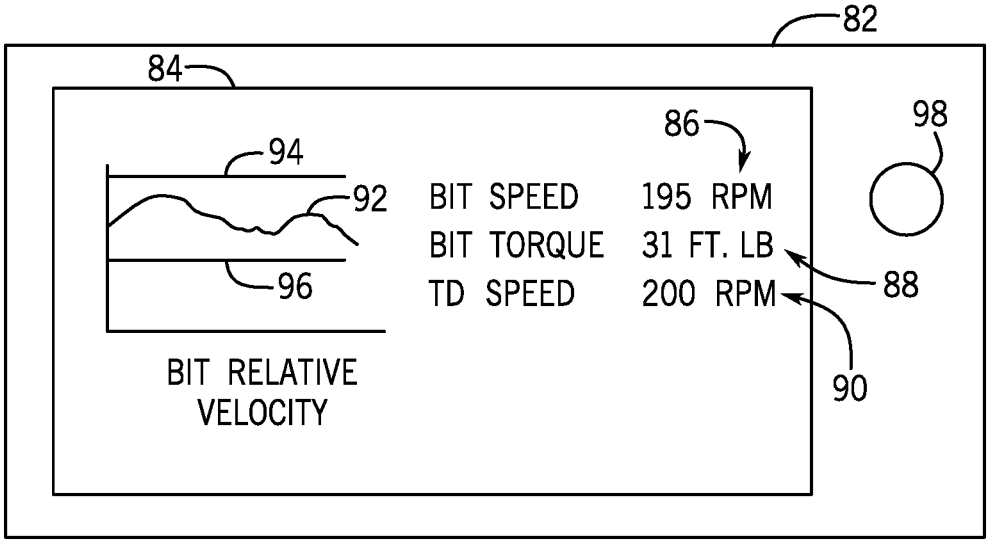
FIG. 3 is a depiction of a user interface for displaying operating parameters of the drilling rig of FIG. 1 in accordance with present techniques.

In addition, although described herein as enabling closed-loop control feedback of, for example, the set torque $\tau_{set}$ and rotational velocity $\dot{\alpha}_{set}$ of the top drive 42, in other embodiments, the estimated values for the rotational velocity and/or the torque of the drill bit 62 may be logged and stored (e.g., in the one or more memory 80) to be used, for example, in the design and control of future drilling rigs, and so forth. In addition, in certain embodiments, the estimated values for the rotational velocity and/or the torque of the drill bit 62 may be displayed to the user (e.g., via the display 84 of the drilling control system 12) such that the user may manually monitor the rotational velocity and/or the torque of the drill bit 62. FIG. 3 illustrates a depiction of the user interface 82 of the drilling control system 12 in accordance with the present disclosure. As illustrated, the current estimated value for the rotational velocity and/or the torque of the drill bit 62 may be displayed (i.e., element number 86) by the display 84. Indeed, it will be appreciated that the display 84 may be used to display any of the operating parameters of the drilling rig 10 described herein. For example, as illustrated in FIG. 3, the current values for the torque $\tau_{TD}$ and rotational velocity $\dot{\alpha}_{TD}$ of the top drive 42, as measured by the one or more sensors 70, may also be displayed (i.e., element numbers 88 and 90, respectively) by the display 84.

Furthermore, in certain embodiments, a time series 92 of the estimated rotational velocity (or the estimated torque) of the drill bit 62 may be depicted with respect to upper and lower operating limits 94, 96, which may be provided as inputs to the main controller 74, and which may be selected to maximize the operating life of the drill bit 62. Such visual representation of the estimated rotational velocity (or the estimated torque) of the drill bit 62 with respect to the upper and lower operating limits 94, 96 over time may enable a user to manually adjust the reference torque $\tau_{ref}$ and/or the reference rotational velocity $\dot{\alpha}_{ref}$ for the top drive 42, for example, by manually manipulating one or more control element(s) 98 (e.g., a knob) of the user interface 82 of the drilling control system 12. Moreover, in certain embodiments, the control elements displayed on the display 84 that correspond to the estimated rotational velocity and/or torque of the drill bit 62 may be caused to change colors (e.g., from green to red) or to flash if the current values of the estimated rotational velocity and/or torque of the drill bit 62 reach (or even approach) one of the upper and lower operating limits 94, 96.

Although primarily described herein as being performed by the main controller 74, in other embodiments, the estimation of the estimated rotational velocity and/or torque of the drill bit 62 may be performed by a processing device 100 (e.g., a computer or other processing device) external to the drilling control system 12, either entirely or in conjunction with the main controller 74. In such embodiments, the main controller 74 may be communicatively coupled to the external processing device 100 via a wired network, a wireless network, or some other data communication network, the measured torque $\tau_{TD}$ and rotational velocity $\dot{\alpha}_{TD}$ of the top drive 42 may be communicated to the processing device 100, the processing device 100 may estimate the rotational velocity and/or the torque of the drill bit 62, and the processing device 100 may communicate the estimated rotational velocity and/or torque of the drill bit 62 back to the main controller 74, store the estimated rotational velocity and/or torque of the drill bit 62 (e.g., in a local memory device) for later usage, or some combination thereof.

As described herein, the main controller 74 may utilize alternative techniques for estimating the rotational velocity and/or the torque of the drill bit 62 and these techniques may be grouped into two main categories, which may be referred to as: (1) infinite dimensional model approximation techniques, and (2) finite dimensional model approximation techniques. In general, the infinite dimensional model approximation techniques include utilizing governing equations of the drill string 30, the top drive 42, and the BHA 60 (including the drill bit 62 itself), which may be transferred into the Laplace domain, whereas the finite dimensional model approximation techniques include, for example, using an assumed mode shape of the drilling string 30, or a finite element model of the drill string 30.

Infinite Dimensional Model Approximation Techniques

Figure 4:
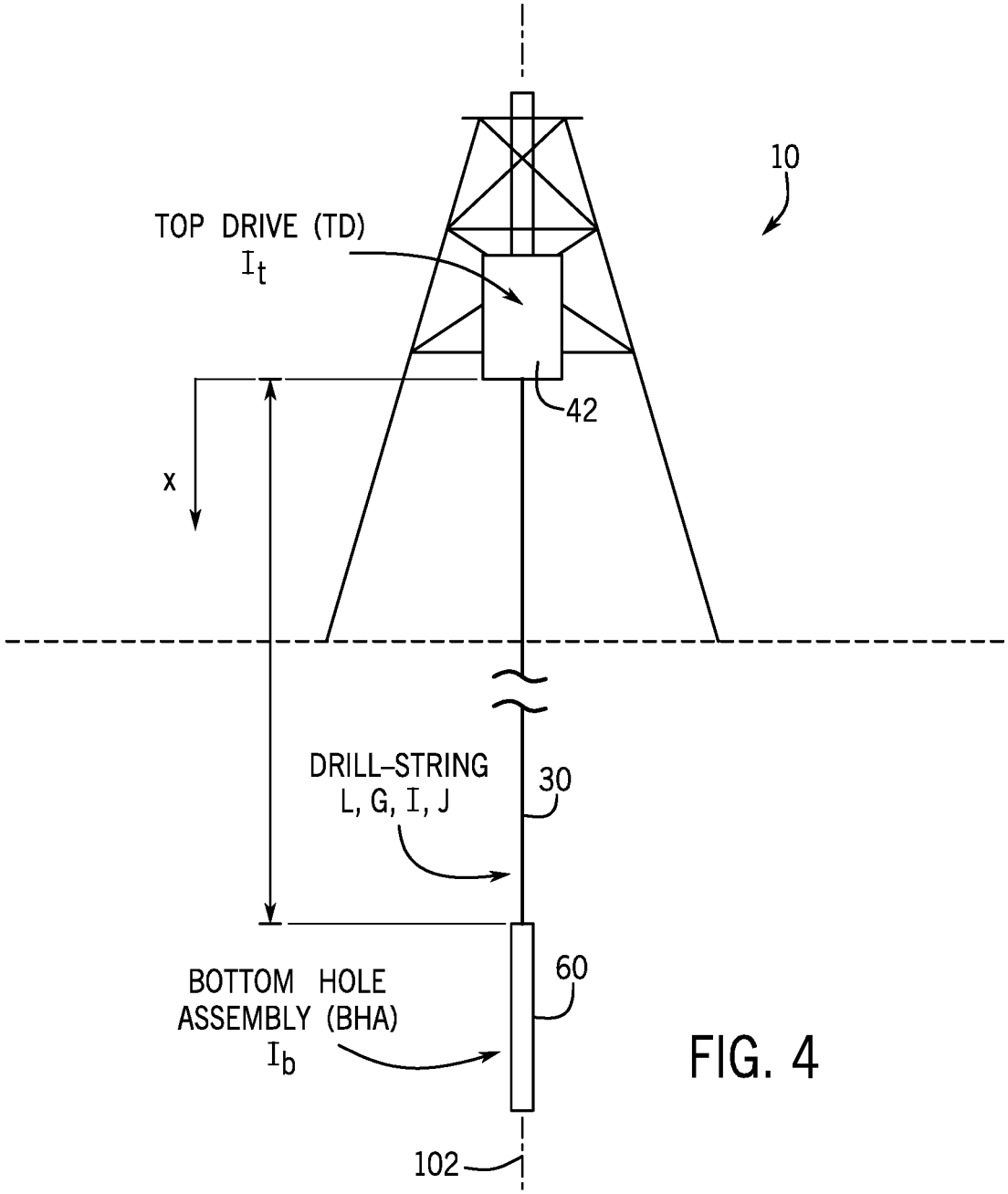
FIG. 4 is a simplified schematic of the drilling rig of FIG. 1 in accordance with present techniques.

FIG. 4 illustrates a simplified schematic of the drilling rig 10 of FIG. 1 in accordance with the present disclosure. As illustrated in FIG. 4, the drill string 30 may be assumed to have a length L, a shear modulus G, a polar moment of inertia J, and a mass moment of inertia per unit length I. In addition, the BHA 60 may be assumed to have a mass moment of inertia $I_b$, and the top drive 42 may be assumed to have an effective mass moment of inertia $I_t$ of:

$$I_t = I_d + n^2 I_m \quad \text{(Eq. 1)}$$

where $I_d$ is the mass moment of inertia of the top drive 42 measured after the gear box of the top drive 42, n is the gear box ratio, and $I_m$ is the rotor mass moment of inertia of the electric motor of the top drive 42 (or the hydraulic motor if the top drive 42 is a hydraulic top drive). I, $I_d$, and $I_b$ are calculated with respect to the axis of rotation 102 of the drill string 30, and $I_b$ is calculated with respect to the axis of rotation 102. It will be appreciated that the dimensions of the drilling rig 10 may be provided to the main controller 74 via a drilling rig configuration file, which may in certain embodiments be stored in the memory 80 of the drilling control system 12, and which may in certain embodiments may be modified by a user via the user interface 82 of the drilling control system 12.

Figure 5A:
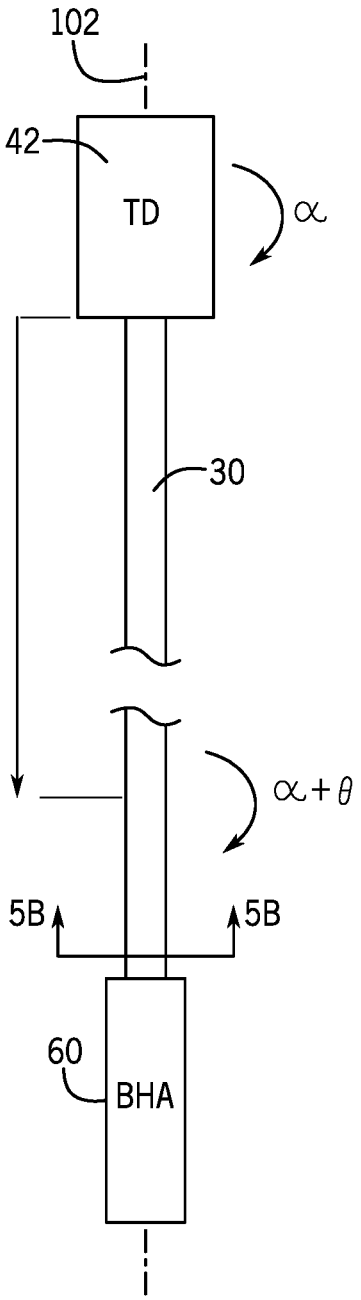
FIG. 5A is a further simplified schematic of a top drive, drill string, and bottom hole assembly of the drilling rig of FIG. 4 in accordance with present techniques.
Figure 5B:
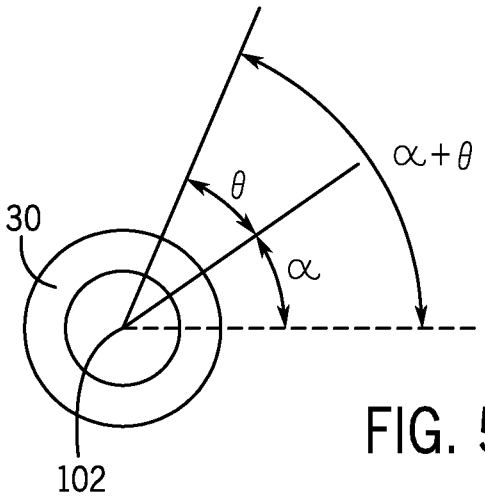
FIG. 5B is a schematic cross-sectional view of a drill string of FIG. 5A taken along A-A in accordance with present techniques.

FIG. 5A illustrates a further simplified schematic of the top drive 42, drill string 30, and BHA 60 of the drilling rig 10 of FIG. 4, and FIG. 5B illustrates a schematic cross-sectional view of the drill string 30 of FIG. 5A taken along A-A (i.e., near the BHA 60) in accordance with the present disclosure. The angular rotation of drill bit 62 may be assumed to be $\alpha+\theta$, where: (i) $\alpha$ is the angular rotation imposed on the electric motor of the top drive 42 (or the hydraulic motor if the top drive 42 is a hydraulic top drive), measured after the gear box of the top drive 42, and (ii) $\theta$ is the angular rotation of the drill string 30 superposed on a (i.e., the angular rotation imposed on the top drive 42), which is because of the flexibility of the drill string 30. The governing equations of the motion for the drill string 30 may be assumed to be:

$$JG\theta_{xx}=I(\ddot{\alpha}+\ddot{\theta}) \quad \text{(Eq. 2a)}$$

$$\tau_{TD}+JG\theta_x(0,t)=I_t\ddot{\alpha} \quad \text{(Eq. 2b)}$$

with the associated boundary conditions as:

$$\theta(0,t)=0 \quad \text{(Eq. 3a)}$$

$$-JG\theta_x(L,t)-\tau_{bit}=I_b(\ddot{\alpha}+\ddot{\theta}(L,t)) \quad \text{(Eq. 3b)}$$

where $\ddot{\alpha}=d^2\alpha/dt^2$, $\ddot{\theta}=\partial^2\theta(x,t)/\partial t^2$, $\theta_x=\partial\theta(x,t)/\partial x$, and similar notations are used for similar derivatives, such as $\Theta_\xi=\partial\Theta/\partial\xi$, and the higher derivatives. Also, $\tau_{TD}$ is the drilling torque from the top drive 42 and $\tau_{bit}$ is the drilling torque at the drill bit 62.

Equation 2a is the moment equilibrium for an element of the drill string 30 at any given location x along the axis 102 of the drill string 30 (as measured from the point where the drill string 30 attaches to the bottom of the top drive 42), and Equation 2b is the moment equilibrium for the top drive 42 itself. Equation 3a indicates that the rotation of the top drive 42 and the drill string 30, where the drill string 30 attaches to the top drive 42 (i.e., where x=0), is the same. Equation 3b is the moment balance for the BHA 60. Assuming that the $\theta(x, 0)=\alpha(0)=0$ and $\dot{\theta}(x, 0)=\dot{\alpha}(0)=0$, the Laplace transform of Equation 2a is:

$$JG\Theta_{xx}=s^2I(\Phi+\Theta) \quad \text{(Eq. 4)}$$

where $\Theta$ and $\Phi$ are the Laplace transforms of $\theta$ and $\alpha$, respectively. From Equation 4, the value $\Theta$ is:

$$\Theta(x, s) = A\sinh\left(\frac{s}{c}x\right) + B\cosh\left(\frac{s}{c}x\right) - \Phi(s) \quad \text{(Eq. 5)}$$

where $JG/I=c^2$. Applying the conditions in Equations 2b and 3a (in the Laplace domain) to Equation 5 leads to:

$$\Theta(x, s) = \left[-\frac{c}{JGs}\sinh\left(\frac{s}{c}x\right)\right]\Gamma_{TD} + \left[\cosh\left(\frac{s}{c}x\right) - 1 + \frac{cs}{JG}I_t\sinh\left(\frac{s}{c}x\right)\right]\Phi \quad \text{(Eq. 6)}$$

where $\Gamma_{TD}$ is the Laplace transfer of $\tau_{TD}$. The angular (e.g., rotational) velocity of the drill bit 62 (or, at least, near the drill bit 62) by calculating the derivative to Equation 6 at x=L (i.e., where the drill string 30 attaches to the BHA 60), which leads to:

$$s\Theta(L, s) = F(s)\Gamma_{TD} + G(s)s\Phi \quad \text{(Eq. 7)}$$

$$F(s) = -\frac{c}{JG}\sinh\left(\frac{s}{c}L\right) \quad \text{(Eq. 8)}$$

$$G(s) = \cosh\left(\frac{s}{c}L\right) - 1 + \frac{cs}{JG}I_t\sinh\left(\frac{s}{c}L\right) \quad \text{(Eq. 9)}$$

Therefore, in certain embodiments, the Laplace transform of the top drive 42 and the angular (rotational) velocity of the top drive 42 may be found first, then multiplied by F(s) and G(s), respectively, and then the inverse Laplace transform may be obtained to get the vibration near the drill bit 62 (or $\dot{\theta}(L, t)$), which is in the time domain. In certain embodiments, this calculation may alternatively be performed in the Fourier (i.e., frequency) domain. To find the actual angular (rotational) velocity near the drill bit 62, the rotational velocity $\dot{\alpha}$ of the top drive 42 should be added to the near-bit vibration (i.e., $\dot{\theta}(L,t)$.

In certain embodiments, by combining Equation 6 and Equation 3b, the torque $\tau_{bit}$ on the drill bit 62 may also be estimated. Additionally, in certain embodiments, it may also be possible to include the viscous damping effect of the drilling mud on the dynamic equations. For example, in such embodiments, Equation 2a could be revised to include the damping effect of the drill mud, and may be written as:

$$JG\theta_{xx}=I(\ddot{\alpha}+\ddot{\theta})+D\dot{\theta} \quad \text{(Eq. 2a (revised))}$$

where D is the damping effect due to the drilling mud.

Furthermore, it will be appreciated that the absolute rotation of the drill bit 62 will also include the actual angular rotation of the drill bit 62 relative to the axial end of the drill string 30 (e.g., at the BHA 60), which may be affected by the flow of the drilling mud, for example. As such, in certain embodiments, the absolute rotation of the drill bit 62 may be calculated as the angular rotation a imposed on the electric motor of the top drive 42 (or the hydraulic motor if the top drive 42 is a hydraulic top drive) plus the angular rotation $\theta$ of the drill string 30 superposed on a (i.e., the angular rotation imposed on the top drive 42) plus the actual angular rotation of the drill bit 62 relative to the axial end of the drill string 30 (e.g., at the BHA 60). It will be appreciated that the angular (rotational) velocity of the drill bit 62 may be similarly calculated (e.g., as the rotational velocity $\dot{\alpha}_{TD}$ of the top drive 42 plus the rotational velocity of the drill string 30 superposed on the rotational velocity $\dot{\alpha}_{TD}$ of the top drive 42 plus the actual angular rotation of the drill bit 62 relative to the axial end of the drill string 30 (e.g., at the BHA 60)).

FIG. 6 illustrates a flow chart of a method 104 for estimating the rotational velocity and/or the torque of the drill bit 62 using the infinite dimensional model approximation techniques (e.g., which may be performed by the main controller 74 of the drilling control system 12 and/or the external processing device 100) in accordance with the present disclosure. The method 104 includes receiving sensor data relating to operating parameters of the top drive 42 of the drilling rig 10 from sensors (e.g., from the one or more sensors 70) of the top drive 42 (block 106). For example, the operating parameters of the top drive 42 that are measured by the one or more sensors 70 may include rotational velocity of the top drive 42 and torque of the top drive 42.

The method 104 also includes estimating (e.g., using the one or more processors 72, a processor of the external processing device 100, or some combination thereof) at least one operating parameter of the drill bit 62 using an infinite dimensional model, for example, wherein governing equations of operating components of the drilling rig 10 are transferred into the Laplace domain, as described herein, and using the sensor data received from the sensors 70 of the top drive 42 (block 108). For example, at least one parameter of the drill bit 62 that may be estimated may include rotational velocity of the drill bit 62 and/or torque on the drill bit 62. In addition, the operating components of the drilling rig 10 that may be modeled include the top drive 42, the drill string 30 of the drilling rig 10, and the BHA 60, which includes the drill bit 62.

In addition, in certain embodiments, the method 104 may include activating an alert relating to the estimated at least one parameter of the drill bit 62 via a user interface (e.g., the user interface 82 of the drilling control system 12 (block 110). For example, as described herein, the alert may include depicting a time series 92 of the at least one parameter of the drill bit 62 with respect to upper and lower operating limits 94, 96, changing colors of, or flashing, control elements that correspond to the at least one parameter of the drill bit 62, and so forth. In addition, in certain embodiments, the method 104 may include controlling (e.g., using the one or more processors 72, a processor of the external processing device 100, or some combination thereof) operation of the top drive 42 based at least in part on the estimated at least one operating parameter of the drill bit 62 (block 112). For example, the rotational velocity of the top drive 42 and the torque of the top drive 42 may be controlled based at least in part on the estimated at least one operating parameter of the drill bit 62. Alternatively, in certain embodiments, the method 104 may include calibrating (e.g., using the one or more processors 72, a processor of the external processing device 100, or some combination thereof) the control of the top drive 42 based at least in part on the estimated at least one operating parameter of the drill bit 62 (block 114).

Finite Dimensional Model Approximation Techniques

As an alternative to the infinite dimensional model approximation method, the finite dimensional model approximation method may be referred to as the assumed mode shape method. In this method, the rotation of the drill string 30 due to flexibility (i.e., $\theta(x,t)$ illustrated in FIGS. 5A and 5B), may be represented by the summation of the mode shapes multiplied by time-varying weight functions (where $\eta(x)=\Theta(\xi L)$ is the relationship between non-dimensional and dimensional mode shapes), that is:

$$\theta(x,t)=\sum_{k=1}^{z}\eta_k(x)\gamma_k(t) \quad \text{(Eq. 10)}$$

where z is the number of mode shapes used to model the rotation of the drill string 30 due to flexibility, and $\gamma_k(t)$ is the time-varying weight function of $\eta_k$. The resulting vector of generalized coordinate q for the drill string 30 with the top drive 42 and the BHA 60 is:

$$q=[\alpha\gamma_i \ldots \gamma_z] \quad \text{(Eq. 11)}$$

and the kinetic energy T and potential energy U for the drill string 30 with the top drive 42 and the BHA 60 are, respectively:

$$T=\frac{1}{2}I_t\dot{\alpha}^2+\frac{1}{2}I_b\left(\alpha_t+\sum_{k=1}^{z}\eta_k(L)\dot{\gamma}_k(t)\right)^2+\frac{1}{2}\int_0^L I\left(\alpha_t+\sum_{i=1}^{z}\eta_k(x)\dot{\gamma}_i(t)\right)^2dx \quad \text{(Eq. 12)}$$

$$U=\frac{1}{2}JG\int_0^L\left(\sum_{k=1}^{z}\eta_{kx}(x)\gamma_k(t)\right)^2 \quad \text{(Eq. 13)}$$

where $\eta_{kx}(x)=\partial\eta_k/\partial x$. Since the number of required independent coordinates to kinematically define the drill string 30 with the top drive 42 and the BHA 60 (i.e., q) is infinite, each independent variable must satisfy the following Lagrange's equation:

$$\frac{d}{dt}\left(\frac{\partial T}{\partial \dot{q}}\right)-\frac{\partial T}{\partial q}+\frac{\partial U}{\partial q}=Q \quad \text{(Eq. 14)}$$

By employing the Lagrange equation, the dynamic equation of the drill string 30 with the top drive 42 and the BHA 60 is:

$$M\ddot{q}+Kq=H\Pi \quad \text{(Eq. 15)}$$

where M is the mass matrix, K is the stiffness matrix, and H is a constant matrix that maps the vector $\Pi=[\tau_{TD}\ \tau_{bit}]^T$ to q, and $\tau_{TD}$ and $\tau_{bit}$ are drilling torque (i.e., the torque imposed on the top drive 42) and torque-on-bit (TOB) (i.e., the torque applied to the drill bit 62), respectively. The mass matrix M and the stiffness matrix are, respectively:

$$M=\begin{bmatrix} M_{11} & M_{12} & \ldots & M_{1(z+1)} \\ M_{21} & M_{22} & \ldots & M_{2(z+1)} \\ \vdots & \vdots & \vdots & \vdots \\ M_{(z+1)1} & M_{(z+1)2} & \ldots & M_{(z+1)(z+1)} \end{bmatrix} \quad \text{(Eq. 16)}$$

$$K=\begin{bmatrix} 0 & 0 & \ldots & 0 \\ 0 & K_{11} & \ldots & 0 \\ \vdots & \vdots & \vdots & \vdots \\ 0 & 0 & \ldots & K_{zz} \end{bmatrix}$$

or $$M=\begin{bmatrix} M_{11} & M_{\alpha\gamma} \\ M_{\gamma\alpha} & M_{\gamma\gamma} \end{bmatrix} M=\begin{bmatrix} 0 & 0_{1\times n} \\ 0_{n\times 1} & K_{\gamma\gamma} \end{bmatrix}$$

where

-continued $$M_{11} = I_t + I_b + IL \quad \text{(Eq. 17)}$$

$$M_{\gamma\gamma} = \begin{bmatrix} M_{22} & \dots & M_{2(1+z)} \\ \vdots & \vdots & \vdots \\ M_{(1+z)2} & \dots & M_{(z+1)(z+1)} \end{bmatrix}$$

$$M_{\alpha\gamma} = \lfloor M_{12} \dots M_{1(z+1)} \rfloor$$

$$M_{\gamma\alpha} = M_{\alpha\gamma}^T$$

$$M_{\gamma\gamma} = \begin{bmatrix} K_{11} & \dots & 0 \\ \vdots & \vdots & \vdots \\ 0 & \dots & K_{(z+1)(z+1)} \end{bmatrix}$$

$$M_{1i} = M_{i1} = I_b\eta_i(L) + I\int_0^L \eta_i dx$$

$$M_{ji} = M_{ij} = I_b\eta_i(L)\eta_j(L) + I\int_0^L \eta_i\eta_j dx$$

$$K_{ii} = JG\int_0^L (\eta_{ix})^2 dx$$

Since the rotation at the drill bit 62 is $\beta=\alpha+\Sigma_{k=1}^{z}\eta_k(L)\gamma_k(t)$, the virtual work (i.e., $\delta w$) due to the virtual displacement of the generalized coordinates is:

$$\delta w = (\tau_{TD} - \tau_{bit})\delta\alpha - \left(\sum_{i=1}^{z} \eta_i(L)\delta\gamma_i\right)\tau_{bit} \quad \text{(Eq. 18)}$$

Therefore, the matrix H to map the vector $\Pi=[\tau_{TD}\ \tau_{bit}]^T$ to the generalized force vector is:

$$H = \begin{bmatrix} 1 & -1 \\ 0 & -\eta_1(L) \\ \dots & \dots \\ \dots & \dots \\ 0 & -\eta_z(L) \end{bmatrix} = \begin{bmatrix} 0 & -1 \\ 0_{n1} & H_{bit} \end{bmatrix} \quad \text{(Eq. 19)}$$

where $$H_{bit} = \begin{bmatrix} -\eta_1(L) \\ -\eta_2(L) \\ \vdots \\ -\eta_z(L) \end{bmatrix}$$

Equation 15 can be written as:

$$M_{11}\ddot{\alpha}+M_{\alpha\gamma}\ddot{Y}=\tau_{TD}-\tau_{bit} \quad \text{(Eq. 20a)}$$

$$M_{\gamma\alpha}\ddot{\alpha}+M_{\gamma\gamma}\ddot{Y}+K_{\gamma\gamma}Y=H_{bit}\tau_{bit} \quad \text{(Eq. 20b)}$$

where $$Y = \begin{bmatrix} \gamma_1(t) \\ \gamma_2(t) \\ \vdots \\ \gamma_z(t) \end{bmatrix}$$

Finding $\tau_{bit}$ from Equation 20a and substituting it into Equation 20b results in:

$$(M_{\gamma\gamma}+H_{bit}M_{\alpha\gamma})\ddot{Y}+K_{\gamma\gamma}Y=H_{bit}(\tau_{TD}-M_{11}\ddot{\alpha})-M_{\gamma\alpha}\ddot{\alpha} \quad \text{(Eq. 21)}$$

Using the torque $\tau_{TD}$ and rotational velocity $\dot{\alpha}_{TD}$ of the top drive 42, as measured by the one or more sensors 70, Equation 21 may be solved to find Y (e.g., the rotational acceleration may be found by taking the derivative of $\dot{\alpha}$ with respect to time). Once Y has been determined, the rotational velocity and/or the torque of the drill bit 62 may then be determined.

FIG. 7 illustrates a flow chart of a method 116 for estimating the rotational velocity and/or the torque of the drill bit 62 using the finite dimensional model approximation techniques (e.g., which may be performed by the main controller 74 of the drilling control system 12 and/or the external processing device 100) in accordance with the present disclosure. The method 116 includes receiving sensor data relating to operating parameters of the top drive 42 of the drilling rig 10 from sensors (e.g., from the one or more sensors 70) of the top drive 42 (block 118). For example, the operating parameters of the top drive 42 that are measured by the one or more sensors 70 may include rotational velocity of the top drive 42 and torque of the top drive 42. The method 116 also includes estimating (e.g., using the one or more processors 72, a processor of the external processing device 100, or some combination thereof) at least one operating parameter of the drill bit 62 using a finite dimensional model, for example, based on an assumed mode shape of operating components of the drilling rig 10, as described herein, and using the sensor data received from the sensors 70 of the top drive 42 (block 120). For example, the at least one parameter of the drill bit 62 that may be estimated may include rotational velocity of the drill bit 62 and/or torque on the drill bit 62. In addition, the operating components of the drilling rig 10 that may be modeled include the top drive 42, the drill string 30 of the drilling rig 10, and the BHA 60, which includes the drill bit 62.

In addition, in certain embodiments, the method 116 may include activating an alert relating to the estimated at least one parameter of the drill bit 62 via a user interface (e.g., the user interface 82 of the drilling control system 12 (block 122). For example, as described herein, the alert may include depicting a time series 92 of the at least one parameter of the drill bit 62 with respect to upper and lower operating limits 94, 96, changing colors of, or flashing, control elements that correspond to the at least one parameter of the drill bit 62, and so forth. In addition, in certain embodiments, the method 116 may include controlling (e.g., using the one or more processors 72, a processor of the external processing device 100, or some combination thereof) operation of the top drive 42 based at least in part on the estimated at least one operating parameter of the drill bit 62 (block 124). For example, the rotational velocity of the top drive 42 and the torque of the top drive 42 may be controlled based at least in part on the estimated at least one operating parameter of the drill bit 62. Alternatively, in certain embodiments, the method 116 may include calibrating (e.g., using the one or more processors 72, a processor of the external processing device 100, or some combination thereof) the control of the top drive 42 based at least in part on the estimated at least one operating parameter of the drill bit 62 (block 126).

Although primarily described herein as using a finite dimensional model, for example, based on an assumed mode shape of operating components of the drilling rig 10 in certain embodiments, in other embodiments a finite dimensional model based on a finite element model of the operating components of the drilling rig 10 may instead be used. Such embodiments may enable relatively better approximation at the expense of relatively higher complexity and computational cost. Regardless, such finite element modelling techniques may be implemented in much the same manner as the assumed mode shape techniques described herein.

While only certain features of the present disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A method, comprising:

receiving sensor data relating to a rotational velocity and a torque of a top drive system of a drilling rig from sensors of the top drive system;

estimating, using at least one processor, at least one of a rotational velocity and a torque of a drill bit using a dimensional model of operating components of the drilling rig, wherein the dimensional model comprises an infinite dimensional model wherein governing equations of the operating components of the drilling rig are transferred into the Laplace domain, and using the sensor data received from the sensors of the top drive system; and controlling, using the at least one processor, at least one of the rotational velocity and the torque of the top drive system based at least in part on at least one of the estimated rotational velocity and the estimated torque of the drill bit;

wherein the rotational velocity of the drill bit comprises a rotational velocity of the top drive system plus a rotational velocity of a drill string of the drilling rig superposed on the rotational velocity of the top drive system plus an actual angular rotation of the drill bit relative to an axial end of the drill string.

2. The method of claim 1, further comprising: activating an alert relating to at least one of the rotational velocity and the torque of the drill bit via a user interface of a control system.

3. The method of claim 1, wherein the operating components of the drilling rig comprise the top drive system, a drill string of the drilling rig, and a bottom hole assembly comprising the drill bit.

4. A method, comprising:

receiving sensor data relating to a rotational velocity and a torque of a top drive system of a drilling rig from sensors of the top drive system; and estimating, using at least one processor, at least one of a rotational velocity and a torque of a drill bit using an infinite dimensional model, wherein governing equations of operating components of the drilling rig are transferred into the Laplace domain, and using the sensor data received from the sensors of the top drive system; and controlling, using the at least one processor, at least one of the rotational velocity and the torque of the top drive system based at least in part on at least one of the estimated rotational velocity and the estimated torque of the drill bit;

wherein the rotational velocity of the drill bit comprises a rotational velocity of the top drive system plus a rotational velocity of a drill string of the drilling rig superposed on the rotational velocity of the top drive system plus an actual angular rotation of the drill bit relative to an axial end of the drill string.

5. The method of claim 4, further comprising: controlling, using the at least one processor, at least one of the rotational velocity and the torque of the top drive system based at least in part on at least one of the estimated rotational velocity and the estimated torque of the drill bit.

6. The method of claim 4, further comprising: calibrating, using the at least one processor, control of the top drive system based at least in part on at least one of the estimated rotational velocity and the estimated torque of the drill bit.

7. The method of claim 4, further comprising: activating an alert relating to the at least one of the rotational velocity and the estimated torque of the drill bit via a user interface of a control system.

8. The method of claim 4, wherein the operating components of the drilling rig comprise the top drive system, a drill string of the drilling rig, and a bottom hole assembly comprising the drill bit.

* * * * *